United States Patent [19]

Parker et al.

[11] 3,944,188

[45] Mar. 16, 1976

[54] CONCENTRATING VORTEX SHAKER

[75] Inventors: Bernard Parker, Westport, Conn.; Otto Gross, Bergenfield; Joseph Buchler, Fort Lee, both of N.J.

[73] Assignee: Buchler Instruments Div. of Searle Analytic Inc., Fort Lee, N.J.

[22] Filed: May 20, 1974

[21] Appl. No.: 471,751

[52] U.S. Cl. ..... 259/54; 259/91; 259/DIG. 18; 259/75; 259/56

[51] Int. Cl.[2] ..... B01F 11/00

[58] Field of Search ..... 259/54, 55, 56, 75, 59, 259/91, DIG. 18, DIG. 30; 23/253 R, 259; 165/84, 186

[56] References Cited

UNITED STATES PATENTS

| | | | |
|---|---|---|---|
| 2,384,898 | 9/1945 | Dietert | 165/84 |
| 3,028,476 | 4/1962 | Hug | 259/DIG. 18 |
| 3,170,810 | 2/1965 | Kagan | 117/119 X |
| 3,635,446 | 1/1972 | Kurosawa et al. | 259/54 |

*Primary Examiner*—Richard E. Aegerter
*Assistant Examiner*—Larry Jones
*Attorney, Agent, or Firm*—Karl F. Ross; Herbert Dubno

[57] ABSTRACT

A concentrating vortex shaker for the simultaneous shaking and concentration of a multiplicity of liquid samples comprises a heat-conductive block having a plurality of openings for receiving laboratory vessels containing sample liquids and removably mounted on a base provided with an adjustable eccentric drive for displacing the block in a gyrating motion. An airtight cover is removably mounted on the block and forms a chamber above the samples which can be controllably evacuated. The samples can be heated or cooled by a temperature-controlled liquid which is fed through a channel formed in the block or heated by an adjustable electrical heater provided in the block mounting or cooled by a cooling plate, upon which the block mounts.

11 Claims, 7 Drawing Figures

CONCENTRATING VORTEX SHAKER

FIELD OF THE INVENTION

The present invention relates to shakers and, more particularly, to shakers capable of subjecting a large number of samples, which can be quickly interchanged, to conditions of gyration, heating, cooling, evaporation and evacuation.

BACKGROUND OF THE INVENTION

In scientific laboratory work, it frequently becomes necessary to subject a large number of various samples to gyrating motion (mixing), to heating or cooling, and to evaporation and evacuation, sometimes simultaneously. Devices for performing these tasks separately are readily available but have the disadvantage in that the samples, usually in small numbers, must tediously be transferred from device to device between operations. Although there are some shakers which can perform multiple operations, none to our knowledge can perform all of the above mentioned operations in a simple, compact and readily accessible device. In systems having vacuum facilities, there is usually the problem of "bumping," resulting in a loss of some of the sample liquid due to the splashing or violent boiling caused by the very rapid build-up of vacuum applied to the sample.

OBJECTS OF THE INVENTION

It is therefore an object of the present invention to provide an improved shaker apparatus which can subject samples placed therein to gyrating motion, to heating or cooling, and to evaporation and evacuation, simultaneously or in any combination.

It is another object of the invention to provide an improved shaker apparatus capable of eliminating vacuum bumping.

It is a further object of the invention to provide a shaker apparatus with facilities for the quick exchange of large numbers of samples.

SUMMARY OF THE INVENTION

The above and other objects of the invention are achieved in a shaker apparatus having a base containing a drive assembly which is connected through an eccentric to a heater assembly and optional cooling plate upon which is mounted a thermally conductive vessel block for holding liquid samples to be treated.

The vessel block has, in its upper portion, a large number of openings holding sample laboratory vessels of various size and shape such as tubes, vials and flasks, specific blocks being provided for specific vessels. The vessel blocks can be quickly interchanged by releasing a single shaft having a knurled top which is used to secure the block to the heater assembly.

A tortuous channel is formed in the lower half of the block and connected by nipples and flexible tubing to a source of temperature controlled liquid which can be passed through the channel for cooling or heating the samples in the block, which is made of a highly thermally conductive material such as aluminum.

Alternatively, only cooled liquid can be passed through the channel, the block being heated by an assembly which comprises a silicone rubber heater plate and a thermistor, connected to a control mounted on the base, for adjusting the temperature. However, where required, the only temperature control can be that provided by the heater assembly.

Alternatively, if the block has no channels, the heating can be done by the same heater assembly on which a cooling plate can be mounted through which temperature controlled coolant is circulated. Hereby an optional cooling system is added, which can be mounted or removed at will.

A transparent cover is fitted over the top of the vessel block and held in place by catches provided on the block, the cover forming a chamber above the samples, which is made airtight by a gasket between the cover and the block. A vacuum can be created in the chamber by removing the air therein through a passageway formed in the vessel block and connected through a plug-in fitting with a flexible tube which feeds through a vacuum control system to a vacuum source.

The electrically operated automatic vacuum control system, provides a means for drawing a vacuum from a constant suction source. The vacuum at the start is very low and then slowly increases to its full volume. This method, in conjunction with the gyrating motion of the sample, avoids the bumping effect encountered with other systems of this type. An automatic bleeder valve, electrically controlled, which is another part of the vacuum control system, opens the moment the vacuum source is shut off, to bleed air into the vacuum chamber, thereby preventing oil or water from being drawn into the vacuum chamber and protecting the samples from destruction.

An alternate manual vacuum control system can also be provided.

A gyratory motion is imparted to the vessel block and heater assembly by the eccentric, which forms part of the drive assembly. A counterweight is provided for dynamic balancing of the mass of the vessel block and heater assembly during gyration, thereby preventing unwanted vibrations from being imparted to the entire shaker apparatus. The vessel block and heater assembly are held against rotation by a number of springs (or other restraints) which are connected between the heater assembly and the base, the springs allowing gyrating motion without rotation.

The gyrating motion of the vessel block, which is adjustable by a motor-speed control provided in the base, causes the sample vessels, which are held in close fitting openings, to make contact along their sides with the vessel block, thereby improving heat transfer between the vessels to be heated or cooled and the temperature controlled block. The gyration also causes the sample liquids in the vessels to climb the sides thereof, presenting a larger surface to be subjected to evaporation or evacuation.

BRIEF DESCRIPTION OF THE DRAWINGS

The above and other features of the invention will now be described in detail with reference to the drawings in which.

SPECIFIC DESCRIPTION

Figure 1:
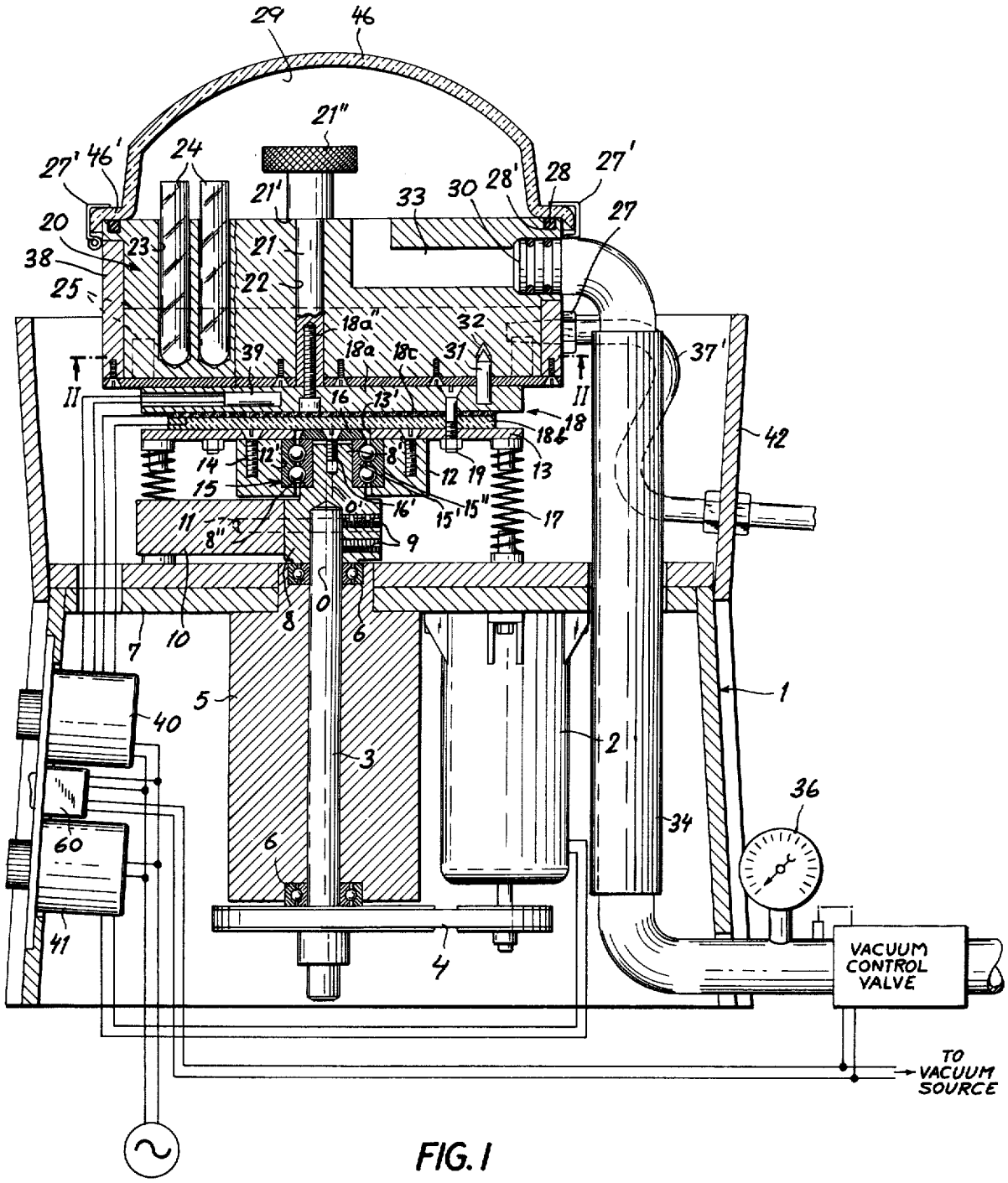
FIG. 1 is a sectional view of a shaker apparatus according to the invention.

FIG. 1 shows a shaker apparatus having a base 1 in which a motor 2 is provided for driving a vertical shaft 3 by way of a pulley arrangement 4. The shaft 3 is journaled in a block 5 by bearings 6, the block 5 being mounted on the top 7 of base 1, with the upper end of shaft 3 passing through the top 7 and engaging an eccentric 8, which is locked to the shaft 3 by setscrews 9. A counterweight 10 is attached to the eccentric 8 by screws 11 (only one shown in dotted lines), the eccentric 8 being provided with an upwardly extending, cylindrical extension 8′ whose axis 0′ is parallel to and offset from the axis 0 of shaft 3.

A bearing block 12 has a recess 12′ into which is fitted a bearing 15, having an inner race 15′ which surrounds the extension 8′ and is held in place there between a washer 16, fastened to extension 8′ and is held in place there between a washer 16, fastened to extension 8′ by a screw 16′ and a shoulder 8″, formed on eccentric 8. A mounting plate 13 is attached to the block 12 by screws 14 and is provided with a central opening 13′ which surrounds the washer 16, the plate 13 overlying the outer race 15″ of bearing 15. The plate 13 is also provided with springs 17 which are attached to the top 7 of base 1 for biasing the plate 13 against rotation and providing additional support for the block 20.

A heater assembly 18 is mounted on plate 13 by screws 19 and comprises a heat conducting plate 18*a* and a thermal insulating plate 18*b* between which is provided a silicone rubber electric-resistance heater of conventional design 18*c*.

A vessel-holding block 20 is removably mounted on heater assembly 18 by a shaft 21, passing through a bore 22 formed in block 20 and threadedly engaging a stud 18*a*″ provided on plate 18*a*, a shoulder 21′ formed on shaft 21 being provided for engaging and holding block 20 in place on the heater assembly.

Figure 2:
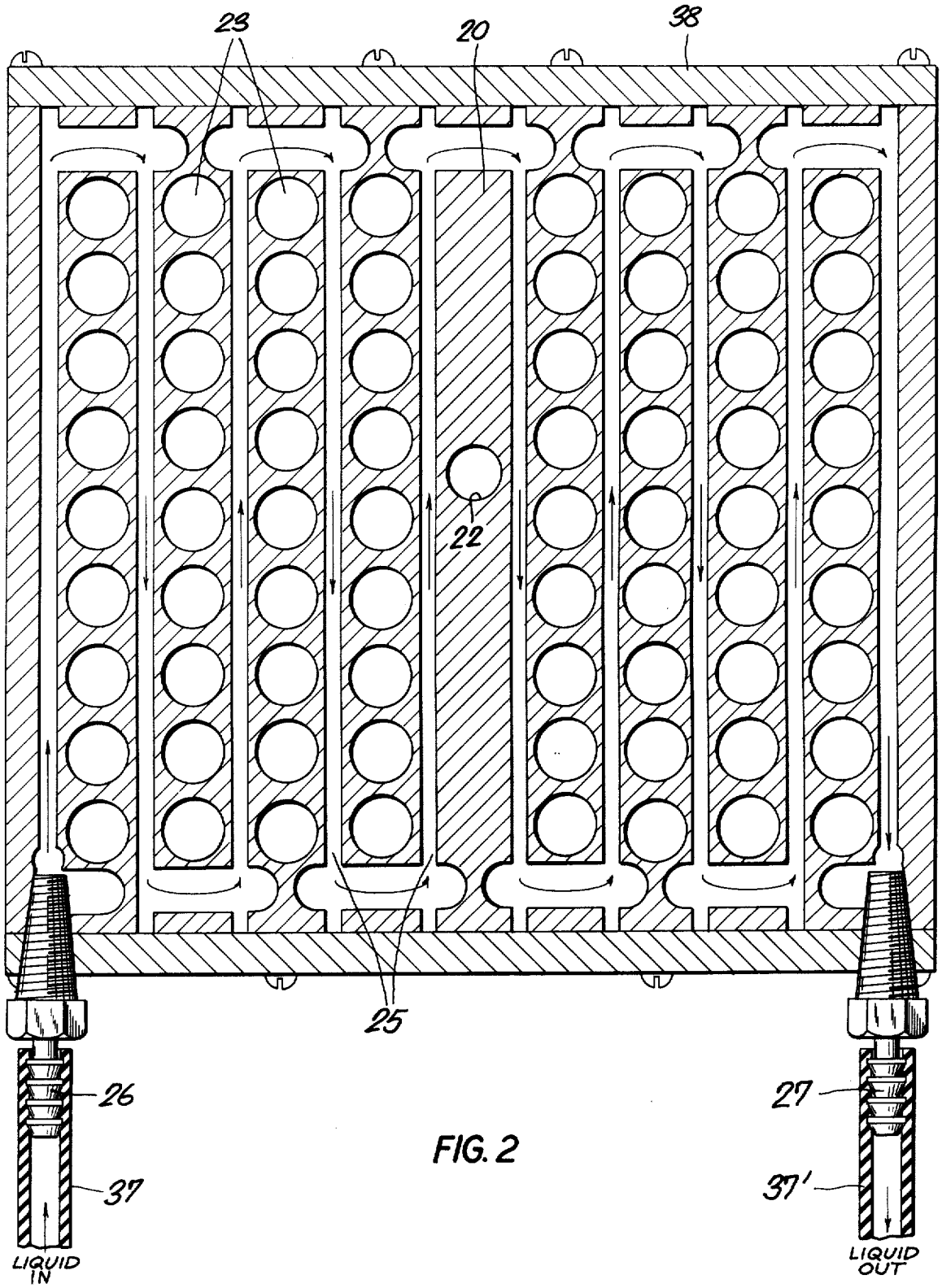
FIG. 2 is a view taken along line II—II of FIG. 1.

The block 20 is provided with an array of openings 23, as can best be seen in FIG. 2, for holding sample vessels, such as those shown at 24. A channel 25 is formed in the lower half of block 20 for passing a temperature-controlled liquid in an undulating path past the openings 23, the liquid entering the block 20 through a nipple 26 and leaving through a nipple 27. A jacket 38 surrounds the sides and bottom of block 20 for confining the liquid within the channels 25, which are open at the bottom and two sides of block 20.

A cover 46, made of plastic or glass for visibility (or metal) overlies the block 20 and has a skirt 46′ which rests along the edges of the block, engageable by catches 27 to the block 20. A sealing ring 28 provided in a groove 28′ formed in the top of block 20, provides an airtight gasket for the chamber 29, formed between the cover 46 and the block 20, the sealing ring 28 engaging the skirt 46′.

In operation, the block 20 can be removed from the shaker by loosening the shaft 21 by the knurled knob 21″ provided thereon and disconnecting the nipples 26, 27 and vacuum connector 30 from the block, if remote sample loading is desired or replacement with a preloaded vessel block. The loaded vessel block, which can have different size and shaped openings for different kinds of sample vessels, is placed on the heater assembly 18 of the shaker and oriented thereon by an indexing pin 31 provided on plate 18*a*, engaging with a bore 32 in block 20 and locked into place by the shaft 21. The transparent cover 46 is then placed on the block 20 and the catches 27 are engaged.

Figure 3:
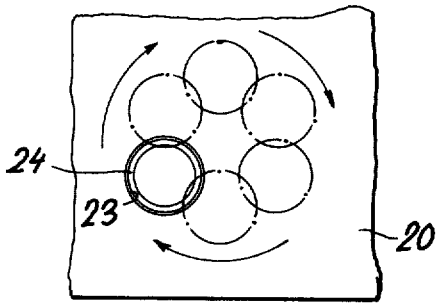
FIG. 3 is a top view of a portion of FIG. 1.

The samples contained in the vessels 24 can be subject to a variety of conditions, such as gyrating motion, as shown in FIG. 3, or evacuation, heating, cooling and evaporation, all at the same time or separately or in any combination.

Figure 5A:
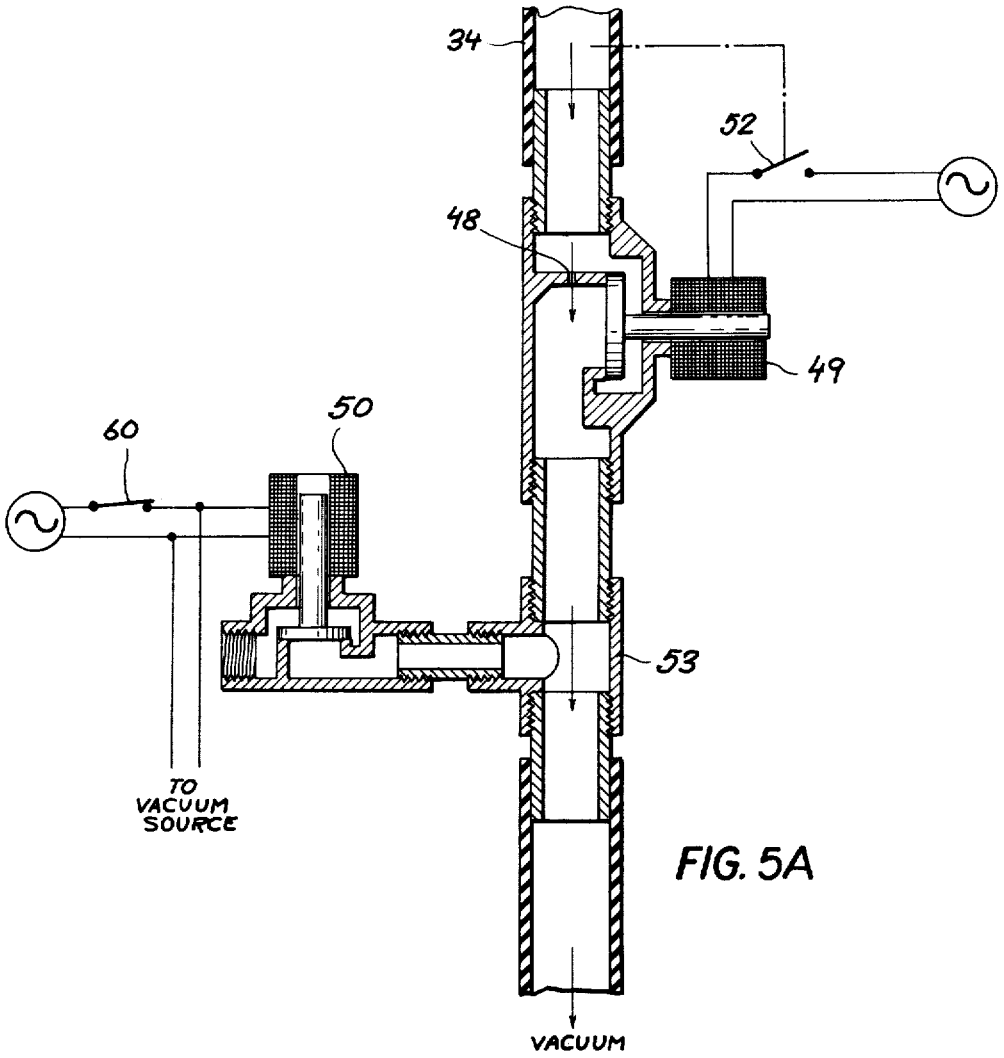
FIG. 5A is a sectional view of a vacuum control system showing the slow buildup of vacuum.
Figure 5C:
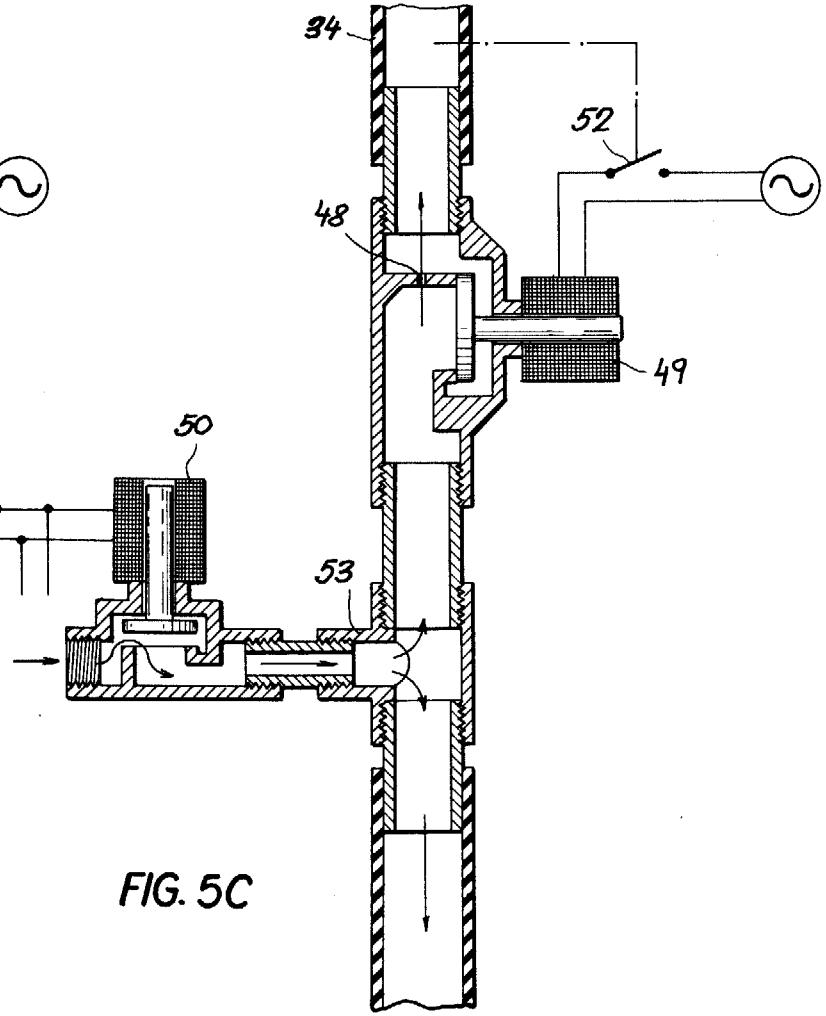
FIG. 5C is a sectional view of the vacuum system shown in FIG. 5A and FIG. 5B in the air-bleeding position.
Figure 5B:
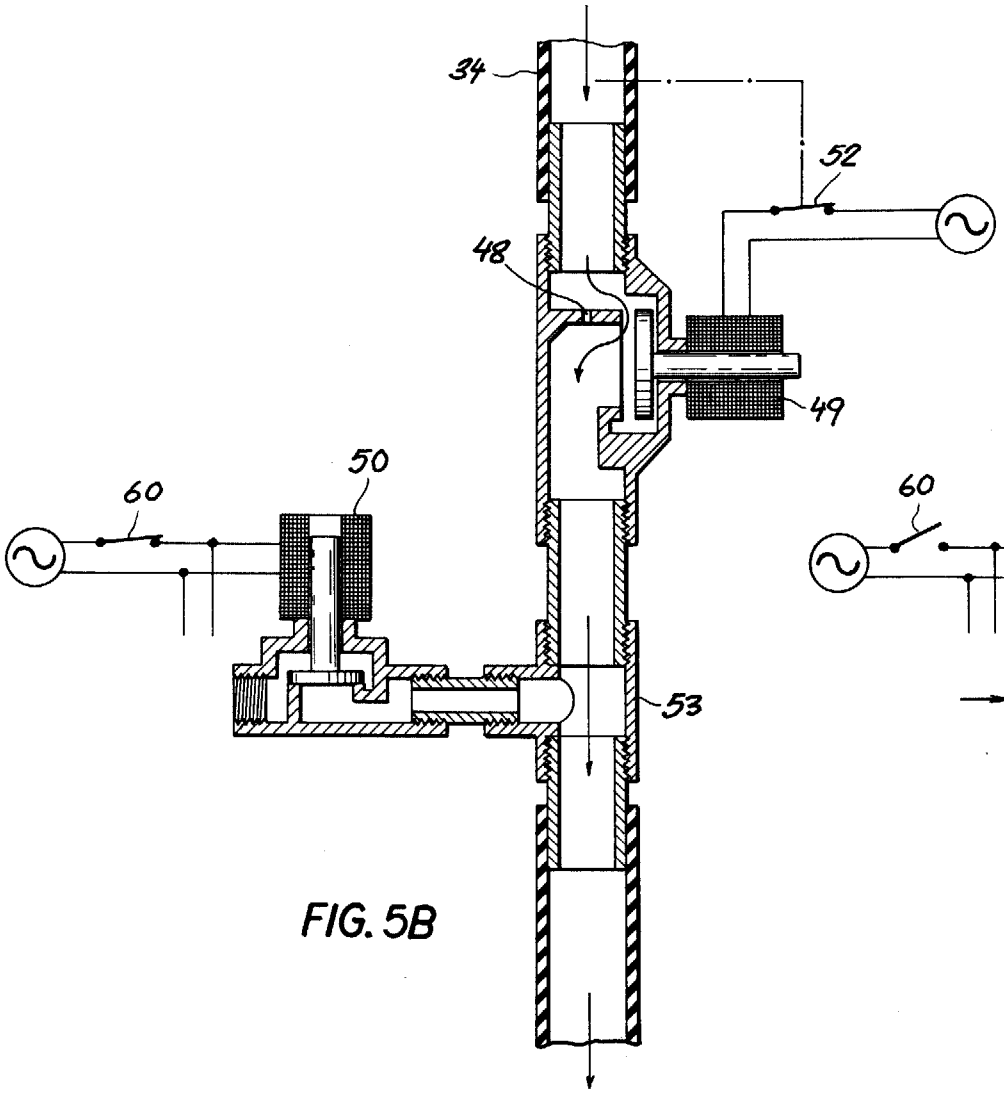
FIG. 5B is a sectional view of the vacuum system of FIG. 5A in normal operation.

A vacuum can be applied to the chamber 29 through a passageway 33 formed in the block 20 and communicating through a connector 30 with a flexible vacuum line 34 provided with an automatic control valve system shown in FIGS. 5A, 5B and 5C for gradually building up the vacuum in chamber 29, provided by a vacuum source not shown and a vacuum gage 36 for monitoring the amount of vacuum present in the line 34.

The system employs one large orifice solenoid valve 49 normally closed, connected to a vacuum sensitive switch 52 set to close at a pressure of 25 IN Hg. A small orifice solenoid valve 50, normally open, acts as a bleeder valve. The three components are electrically connected by wiring and mechanically connected by pipe fittings and flexible tubing. The solenoid valve 49 is connected to the vacuum chamber 29 by the vacuum connector 30 and flexible tubing 34. On the other side solenoid valve 49 is connected to a vacuum source (pump, aspirator) not shown. Connected to this flow system by means of a tee 53 is the bleeder valve 50 which bleeds outside air into the system to break the vacuum at the end of the operation thereby preventing oil or water from being drawn into chamber 29. One wall inside the solenoid valve 49 is pierced by a fine bypass nozzle 48 which permits air to flow or vacuum to be pulled very slowly. This nozzle 48 is permanently open. After the instrument has been prepared for vacuum operation, the vacuum source is turned on by means of a multiple function switch 60. The bleeder valve 50, normally open, is now energized — closed solenoid valve 49 remains closed. The air in the vacuum chamber 29 (not shown) is now slowly exhausted through the by-pass nozzle 48. When the vacuum reaches 25 IN. Hg the vacuum sensitive switch 52 activates the solenoid valve 49 which is energized open. This now permits the vacuum to be pulled at full volume until the end of operation.

The samples contained in vessel block 20 can be subjected to cooling by passing a cooled liquid through the channels 25, from a flexible tube 37 connected to inlet nipple 26 and a source of controlled-temperature liquid not shown (e.g. a thermostatic bath) and leaving the vessel block 20 through the outlet nipple 27 connected to a flexible tube 37′. If heating of the samples contained in vessel block 20 is desired a heated liquid can be passed through the block in the same manner as that described for the cooling of the samples.

An alternative method for heating the samples contained in the vessel block 20 is provided by the heater assembly 18, which contains a thermistor 39, provided in heater plate 18*a* and connected to an adjustable heating control 40, which accurately adjusts the amount of heating produced by the silicone rubber heater 18*c*, to which it is also connected.

Figure 4:
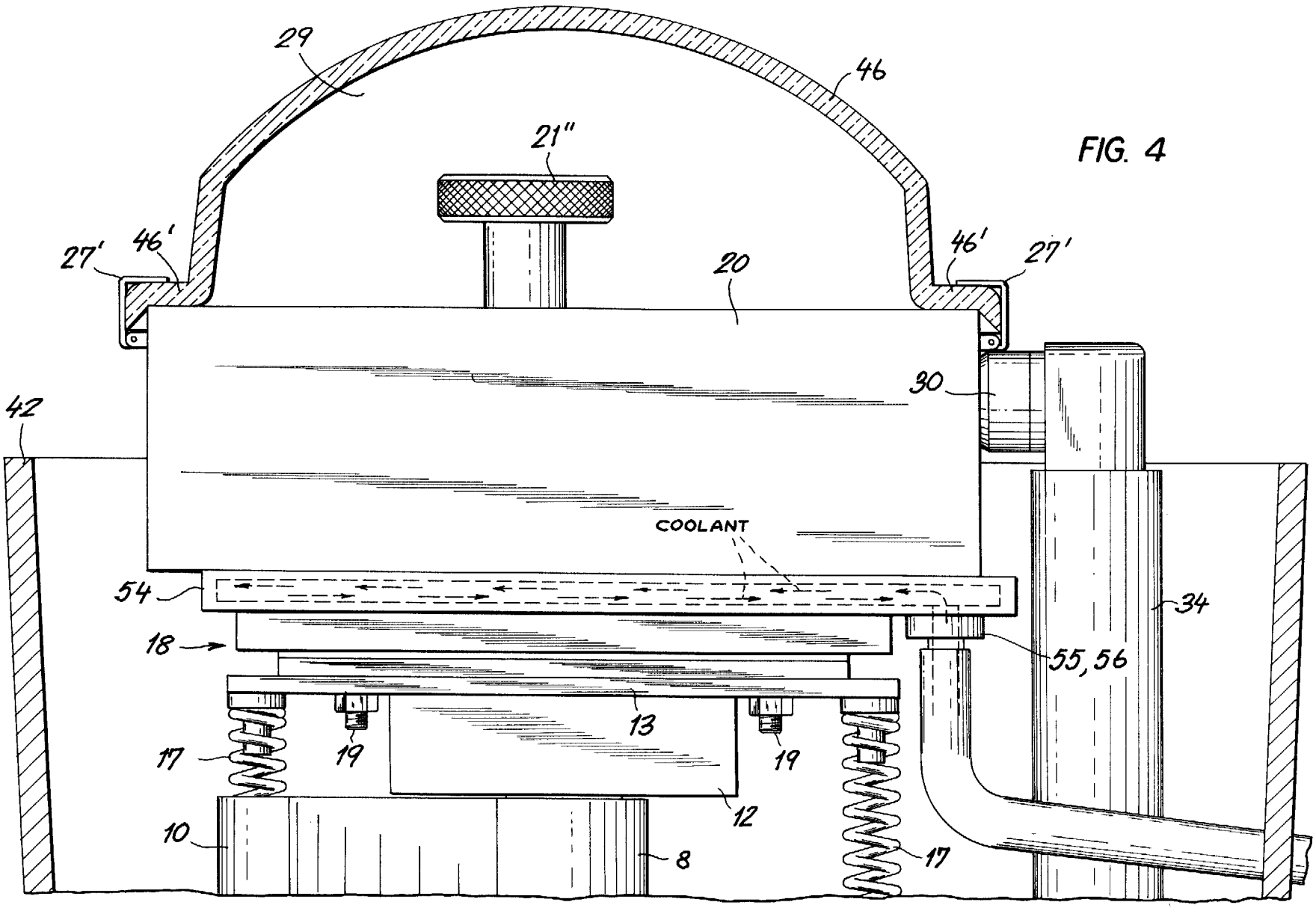
FIG. 4 is a view similar to FIG. 1 showing another embodiment.

Another alternative method is shown in FIG. 4 in which the block 20 has no channel to conduct liquid and therefore needs no nipples or flexible tubing. In this case a cooling plate 54, FIG. 4 is mounted atop the heater assembly 18.

The cooling plate 54 in turn carries the vessel block 20. The cooling plate 54 carries two nipples, 55 and 56 through which controlled coolant circulates inside cooling plate 54. The nipples 55, 56 are connected to a refrigerated liquid source (not shown) by flexible tubing. The vessel block 20 constructed without internal channels and external tube connections is now much easier to exchange.

The cooling plate 54 remains permanently connected to the unit.

The rate of gyration to which the samples are subjected is regulated by a speed control 41 to which the drive motor 2 is connected.

The entire shaker assembly is surrounded by a protective skirt 42, attached to the base 1 and extending upwardly to just below the nipples 26, 27 and the vacuum connector 30.

We claim:

1. a shaker apparatus, comprising:

a base;

a heat-conductive block movably mounted on said base;

drive means on said base for displacing said block in gyrating motion;

said block having a plurality of openings for receiving sample vessels;

an airtight cover on said block, overlying said openings and forming a chamber above said block;

suction means for creating a vacuum in said chamber; and control means for adjusting the temperature of said block, said control means for adjusting the temperature of said block comprising:

a heater assembly carrying and in contact with said block, said heater assembly being provided with a resistance-type heater and a temperature sensor; and a control connected with said heater and said sensor for adjusting the temperature of said assembly.

2. A shaker apparatus as defined in claim 1 wherein said cover is removably attached on said block by catches provided on said block; and said cover is transparent.

3. A shaker apparatus as defined in claim 1, wherein said drive means comprises a motor-driven eccentric drive assembly;

said block is mounted on said heater assembly;

said base is provided with an upwardly extending protective skirt, surrounding said drive assembly and said heater assembly;

said drive assembly includes a motor-speed control and said control means includes a temperature control; and said temperature control and said motor speed control are mounted on said base, remote from any moving parts.

4. A shaker apparatus, comprising:

a base;

a heat-conductive block movably mounted on said base;

drive means on said base for displacing said block in gyrating motion;

a plurality of openings formed in said block for receiving sample vessels;

an airtight cover on said block, overlying said openings and forming a chamber above said block;

suction means for creating a vacuum in said chamber; and control means for adjusting the temperature of said block, said suction means comprising:

a passageway formed in said block and communicating between said chamber and a vacuum source; and means for adjusting and monitoring the rate at which a vacuum is created in said chamber, said adjusting and monitoring means comprising:

a duct communicating between said chamber and said vacuum source;

a first solenoid valve normally closed for controlling the flow of air in said duct between said chamber and said vacuum source;

a second solenoid valve normally open for feeding atmosphere air to said duct between said first solenoid valve and said vacuum source;

a nozzle in said duct for limitedly feeding a flow of air past said first solenoid valve;

means for energizing said vacuum source and said second solenoid valve into a closed position simultaneously;

means responsive to a predetermined level of air pressure in said duct between said chamber and said first solenoid valve for energizing said first solenoid valve into an open position; and a vacuum gauge communicating with said duct between said first solenoid valve and said chamber.

5. A shaker apparatus as defined in claim 4, wherein said drive means comprises:

a drive shaft journaled on said base and rotated by a motor;

a mounting plate removably carrying said block;

an eccentric fixed to said drive shaft and rotatably supporting said mounting plate;

a plurality of springs connected with said mounting plate and said base for resiliently biasing said plate against rotation and carrying the weight of said block;

a counterweight fixed to said eccentric for dynamically balancing said block; and a control for adjusting the speed of said motor.

6. A shaker apparatus as defined in claim 4, wherein said control means for adjusting the temperature of said block comprises:

a channel formed in said heat-conductive block; and means for feeding a temperature-controlled liquid through said channel.

7. A shaker apparatus as defined in claim 6, wherein said channel is provided with removable flexible inlet and outlet tubes for connection to said temperature controlled liquid.

8. A shaker apparatus as defined in claim 4, wherein said control means for adjusting the temperature of said block comprises:

a cooling plate removably carrying said block;

a channel formed in said cooling plate; and means for feeding a temperature-controlled liquid through said channel.

9. A shaker apparatus, comprising:

a base;

a heat-conductive block movably mounted on said base;

drive means on said base for displacing said block in gyrating motion;

a plurality of openings formed in said block for receiving sample vessels;

an airtight cover on said block, overlying said openings and forming a chamber above said block;

suction means for creating a vaccum in said chamber; and control means for adjusting the temperature of said block, said control means including a heater assembly carrying said block; said block being removably mounted on said heater assembly by a single removable central fastening member provided with a manually-grippable top; and an indexing pin provided on said heater assembly and engageable with said block for orientation thereof.

10. A shaker apparatus, comprising:

a base;

a heat-conductive block movably mounted on said base;

drive means on said base for displacing said block in gyrating motion;

a plurality of openings formed in said block for receiving sample vessels;

an airtight cover on said block, overlying said openings and forming a chamber above said block;

suction means for creating a vacuum in said chamber; and control means for adjusting the temperature of said block, said drive means including a drive shaft journaled on said base and rotated by a motor;

a mounting plate removably carrying said block;

an eccentric fixed to said drive shaft and rotatably supporting said mounting plate;

a plurality of springs connected with said mounting plate and said base for resiliently biasing said plate against rotation;

a counterweight fixed to said eccentric for dynamically balancing said block; and a control for adjusting the speed of said motor;

said control means for adjusting the temperature of said block comprises:

a channel formed in said heat-conductive block;

means for feeding a temperature-controlled liquid through said channel;

a heater assembly carrying and in contact with said block, said heater assembly being provided with a resistance-type heater and a temperature sensor; and a control connected with said heater and said sensor for adjusting the temperature of said assembly;

said suction means comprises:

a passageway formed in said block and communicating between said chamber and a vacuum source;

a valve between said passageway and said vacuum source for adjusting the rate at which a vacuum is created in said chamber;

a vacuum gauge between said valve and said chamber for monitoring a vacuum created in said chamber;

said cover is removably attached on said block by catches provided on said block;

said cover is transparent;

said block is removably mounted on said heater assembly by a single removable central fastening member provided with a manually-grippable top; and an indexing pin is provided on said heater assembly and engageable with said block for orientation thereof.

11. A vortex shaker comprising:

a base;

a motor in said base;

a heat-conductive block mounted movably on said base and connected to said motor for gyratory movement of said block by said motor, said block being formed with a plurality of upwardly open pockets adapted to receive sample vessels;

means for selectively heating and cooling said block to vary the temperature thereof;

a cover detachably engaging said block and enclosing said pockets while forming a hermetic seal with said block while defining a chamber above said pockets common to all said pockets;

suction means communicating with said chamber for inducing a suction therein; and control means connected to said suction means for regulating the generation of suction in said chamber to prevent bumping of said liquid in said vessels.

* * * * *